US010125563B2

(12) United States Patent
Murphy

(10) Patent No.: US 10,125,563 B2
(45) Date of Patent: Nov. 13, 2018

(54) SUBSEA COMPLETION APPARATUS AND METHOD INCLUDING ENGAGEABLE AND DISENGAGEABLE CONNECTORS

(71) Applicant: FMC Technologies, Inc., Houston, TX (US)

(72) Inventor: Richard M. Murphy, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 15/028,582

(22) PCT Filed: Oct. 14, 2014

(86) PCT No.: PCT/US2014/060345
§ 371 (c)(1),
(2) Date: Apr. 11, 2016

(87) PCT Pub. No.: WO2015/057608
PCT Pub. Date: Apr. 23, 2015

(65) Prior Publication Data

US 2016/0251926 A1 Sep. 1, 2016

Related U.S. Application Data

(60) Provisional application No. 61/890,673, filed on Oct. 14, 2013.

(51) Int. Cl.
*E21B 33/038* (2006.01)
*E21B 34/04* (2006.01)
(Continued)

(52) U.S. Cl.
CPC ..... *E21B 33/0385* (2013.01); *E21B 33/038* (2013.01)

(58) Field of Classification Search
None
See application file for complete search history.

(56) References Cited

U.S. PATENT DOCUMENTS 3,635,184 A 1/1972 Liautaud
3,976,347 A 8/1976 Cooke, Sr. et al.
(Continued)

FOREIGN PATENT DOCUMENTS

FR 2050602 A5 4/1971
WO 2015061395 A2 4/2015

OTHER PUBLICATIONS

Written Opinion issued in Singaporean Application No. 11201602896S; dated Sep. 21, 2016 (8 pages).
(Continued)

*Primary Examiner* — Matthew R Buck
*Assistant Examiner* — Douglas S Wood
(74) *Attorney, Agent, or Firm* — Osha Liang LLP

(57) ABSTRACT

A communication link between a first subsea device and a second subsea device includes a first component positioned upon a distal end of the first subsea device and a second component positioned upon a proximal end of the second subsea device, wherein one of the first and second components comprises an engaged position and a disengaged position, and wherein the one of the first and second components is configured to be displaced from the disengaged position to the engaged position after the first and second subsea devices are engaged.

21 Claims, 7 Drawing Sheets

(51) Int. Cl.
*F15B 1/027* (2006.01)
*F15B 11/032* (2006.01)

(56) References Cited

U.S. PATENT DOCUMENTS

| | | | | |
|---|---|---|---|---|
| 5,749,608 | A * | 5/1998 | Wilkins | E21B 33/0355 285/123.12 |
| 7,291,028 | B2 * | 11/2007 | Hall | E21B 17/028 439/192 |
| 7,566,045 | B2 * | 7/2009 | June | E21B 33/043 137/625.48 |
| 9,097,861 | B2 * | 8/2015 | Hatcher | G02B 6/3816 |
| 2007/0010119 | A1 | 1/2007 | Hall et al. | |
| 2014/0370735 | A1 * | 12/2014 | Nicholson | H01R 13/523 439/271 |

OTHER PUBLICATIONS

International Search Report issued in PCT/US2014/060345 dated Oct. 8, 2015 (3 pages).
Written Opinion of the International Searching Authority issued in PCT/US2014/060345 dated Oct. 8, 2015 (6 pages).
Examination Report issued in Australian Application No. 2014334598; dated Jul. 6, 2016 (3 pages).
Extended European Search Report issued in European Application No. 17194253.5; dated Feb. 21, 2018 (7 pages).

* cited by examiner

SUBSEA COMPLETION APPARATUS AND METHOD INCLUDING ENGAGEABLE AND DISENGAGEABLE CONNECTORS

BACKGROUND OF THE DISCLOSURE

Field of the Disclosure

The present invention relates to methods and apparatuses to make signal path connections between adjacent oilfield devices. More particularly, the present invention relates to methods and apparatuses to make wetmateable signal path connections between adjacent devices in a subsea wellhead stack. More particularly still, the present invention relates to methods and apparatuses to make wetmateable signal path connections between adjacent subsea wellhead stack devices such that the signal path connections may be engaged and/or disengaged without requiring the separation, decoupling, or disengagement between the adjacent subsea devices.

Description of the Related Art

Subsea wellhead assemblies are often used when drilling subterranean formations lying beneath increasingly large depths of ocean water. Because of the challenges associated with performing complex mechanical, electrical, chemical, and hydraulic operations on sea floors beneath hundreds or thousands of meters of sea depth, various connection mechanisms and remotely operated vehicles (ROVs) are used to perform operations where humans cannot directly be present. Following drilling operations, the subsea wellhead must be re-configured from a drilling configuration, to a completion and/or production configuration, whereby conditions and fluids of the subterranean reservoir may be tested, evaluated, and/or produced to the surface for recovery, storage, and transport to a terminal location.

Referring briefly to FIG. 1, a typical subsea completion system 28 comprising a number of devices, such as a wellhead 34, a tubing hanger 38, a tree 30, and blowout preventer (BOP) stack 36 are shown. Such systems (e.g., completion system 28) may also comprise a number of tools which are used temporarily during installation and testing of completion system 28. These tools may include a lower riser package ("LRP"), an emergency disconnect package ("EDP"), and a tubing hanger running tool ("THRT"). During installation, testing, and production, these components and tools are stacked atop and connected to each other in a desired configuration. During the assembly, testing, and production phases of most common subsea systems, the various components are stacked in a particular order, such that a lower connector or flange of each device engages a corresponding upper hub or flange portion of the next device in the "stack" of subsea wellhead devices.

Historically, wetmateable connections between subsea wellhead stack devices (e.g., valve bodies, vertical trees, blowout preventers, tubing hangers, wellhead couplers, etc.) have been "made up" or "broken out" at the time such components are landed, bolted, or otherwise coupled together. Typically, an upper subsea wellhead device includes a plurality of feed-through signal path connection devices extending from a distal end of the device, while the device to be mated to below comprises a plurality of corresponding connection devices upon its proximal end. Thus, the aforementioned signal path connections are made concurrently with the subsea wellhead devices themselves. However, under this arrangement, the only way to break out the signal path connection is to physically separate the adjacent subsea wellhead devices, requiring significant effort and the assistance of subsea ROVs and/or lifting cranes, etc. While there historically has been little need to disconnect the signal path feed-through connections independent of the subsea wellhead devices they connect, there may be advantages to constructing subsea wellhead devices capable of having their signal pathways disconnect independent of the devices themselves.

As used herein, the term, "wetmateable" is defined to include, but not be limited to, any signal pathway or conduit connection in which two environment-immune components are mated together to form either a pressure containing and/or controlling conduit (mechanical, hydraulic, electrical, fiber optical, or otherwise) pathway across the two components. Typically, wetmateable connections are used in environments (such as subsea drilling) where isolating a surrounding or "wet" fluid environment from the proximity of the connection components would otherwise be difficult or extremely costly. For example, a signal pathway connection between a vertical tree and a tubing hanger atop a subsea wellhead could employ a wetmateable connection such that upon engagement of the two components of the signal path, any fluid (e.g. seawater or ambient air) surrounding the connector immediately prior to forming the connection is prevented from interfering with the made-up hydraulic connection. Thus, hydraulic wetmateable connections would prevent surrounding water or air from interfering with the hydraulic fluid of a hydraulic signal path. Similarly, fiber-optic, mechanical, or electrical, wetmateable connections would prevent a surrounding fluid from interfering with the connection or performance of their corresponding optical, mechanical, or electrical signal pathways passing through adjacent subsea wellhead designs.

SUMMARY OF THE CLAIMED SUBJECT MATTER

In one aspect, the present disclosure relates to a method to communicate between a first subsea device and a second subsea device including disposing a first component of a signal pathway upon a distal end of the first subsea device, disposing a second component of the signal pathway upon a proximal end of the second subsea device, engaging the first subsea device with the second subsea device, and engaging the first component of the signal pathway with the second component of the signal pathway.

In another aspect, the present disclosure relates to a communication link between a first subsea device and a second subsea device including a first component positioned upon a distal end of the first subsea device and a second component positioned upon a proximal end of the second subsea device, wherein one of the first and second components comprises an engaged position and a disengaged position, and wherein the one of the first and second components is configured to be displaced from the disengaged position to the engaged position after the first and second subsea devices are engaged.

In another aspect, the present disclosure relates to a method to extend a signal pathway across an adjacent pair of oilfield devices including landing a first oilfield device comprising a first component of the signal pathway to a second oilfield device comprising a second component of the signal pathway, coupling first oilfield device to the second oilfield device, selectively engaging the first component of the signal pathway with the second component of the signal pathway, and testing the integrity of the signal pathway extending across the first oilfield device and the second oilfield device.

BRIEF DESCRIPTION OF DRAWINGS

Features of the present disclosure will become more apparent from the following description in conjunction with the accompanying drawings.

DETAILED DESCRIPTION

Figure 1:
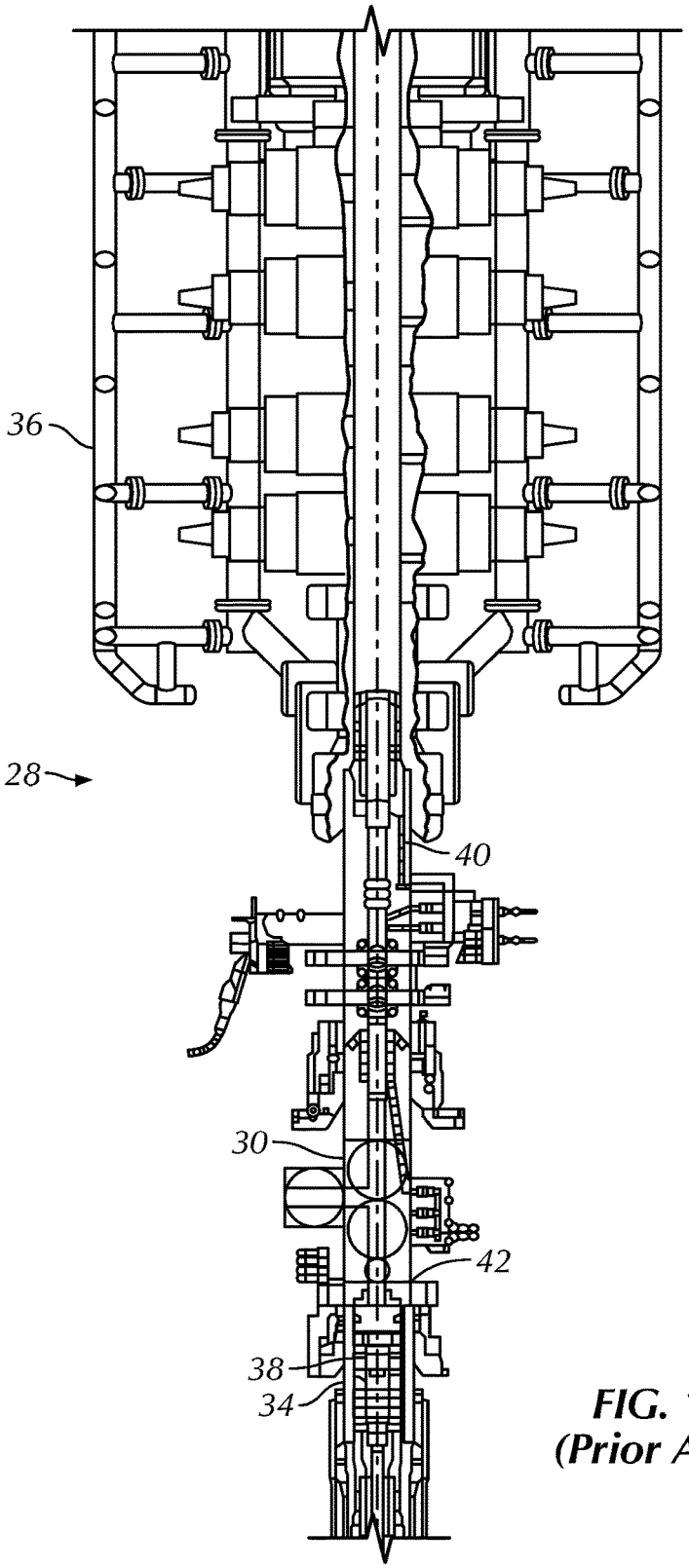
FIG. 1 (Prior Art)
FIG. 1 is a schematic example of a subsea wellhead device stack in accordance with the prior art.

The various embodiments of the present disclosure may include methods and apparatuses to communicate between subsea devices including disposing a first component of a signal pathway to a first subsea device and a second component of the signal pathway to a second subsea device. With the first and second subsea devices installed at their desired location (e.g., atop a subsea wellhead), the first and second subsea devices are able to be engaged together (e.g., secured together with bolting flanges, specialty connectors, and the like) without the first and second components of the signal pathway being connected. As such, the operator (or operator controlled ROV) is able to align and rigidly connect the first and second subsea devices together without concern for damaging the signal pathway components. Following engagement of the first subsea device with the second subsea device, the first and second components of the signal pathway may be engaged such that the signal pathway spanning across the first and second subsea devices is created.

As would be understood by those having ordinary skill in the art, the signal pathway described above could carry and transmit electrical, optical, mechanical, hydraulic, pneumatic, or any other type of "signal" useful in subsea wellbore exploration and/or production across the two adjacent subsea wellhead devices. As would be understood by those having ordinary skill, a "stack" of two or more subsea wellhead devices (e.g., a subsea wellhead, a tubing hanger, a vertical tree, a blowout preventer, etc.) may be constructed such that each subsea device comprises signal pathway components at their distal and proximal ends, such that the entire stack may be assembled and engaged before the signal pathway components are connected. Additionally, following connection of the signal pathway components, an integrity test may be run to ensure proper signal communication across the various devices in the subsea device stack. Should any connection across a particular subsea device-to-device interface fail the integrity test, the signal pathway components of the signal pathway connection in question may be disengaged and subsequently re-engaged in an attempt to correct the signal communication failure.

Thus, the embodiments disclosed herein encompass the ability to engage and disengage single or multiple signal pathway components between an assembly of two or more subsea devices at any time after the devices have been engaged or "landed" together without requiring vertical movement of either of the subsea devices. While the embodiments may include "wetmateable" components for the signal pathway as defined above and understood by those having ordinary skill, wetmateable construction for components of the signal pathways may be optional for any given work environment. Additionally, while the "devices" being connected and spanned by the signal pathways are described as "subsea" devices, those having ordinary skill will appreciate the embodiments disclosed herein may also be applicable to connected devices in other types of service. For example, connections between wellhead stack devices in terrestrial drilling applications may be connected in the same manner. Additionally still, embodiments disclosed herein may also be used to extend signal pathways across adjacent devices in non-wellhead or even non-oilfield applications.

Additionally, while embodiments disclosed herein depict particular mechanisms for engaging and disengaging corresponding components of signal pathways, a person having ordinary skill should understand that various alternative mechanisms may exist without departing from the scope of the claims below. For example, while embodiments disclosed herein depict a "slider-crank" mechanism for "stroking" components of the signal pathways into and out of engagement with their adjacent counterparts, it should be understood that other mechanical, electro-mechanical, hydraulic, and/or pneumatic mechanisms may be used without departing from the scope of the claimed subject matter. Similarly, those having ordinary skill will appreciate that for any given signal pathway across a device-to-device interface, the engagement of corresponding components may be performed by displacing or stroking either or both components of the signal pathway without departing from the subject matter as claimed.

Referring again briefly to FIG. 1, a stack of subsea wellhead devices 28 is shown comprising wellhead 34, tubing hanger 38, tree 30, and BOP stack 36. As would be understood by those having ordinary skill, each device in the subsea wellhead stack 28 may be coupled and decoupled from an adjacent device. One or more signal pathways 40 may extend across each device-to-device interface (e.g., interface 42 between tree 30 and tubing hanger 38) such that signal communications may extend from the surface to the wellbore through the various devices (BOP stack 36, tree 30, tubing hanger 38, and wellhead 30) of subsea wellhead stack 28. While only a single signal pathway 40 is depicted in FIG. 1, those having ordinary skill in the art will appreciate that multiple signal pathways, bundled or separated, may be required to properly communicate with the wellbore below. As should be understood, signal pathways (e.g., 40 of FIG. 1) may comprise fiber-optic, electrical, hydraulic, pneumatic, or mechanical control signals or may serve as conduits for supplying fluids, electrical, or hydraulic power to devices or wellbore components below.

Typically, in subsea wellbore installations, a vertical tree is landed to a wellbore stack of devices including a tubing hanger that suspends one or more strings of production, completion, or workover tubing extending into the wellbore below. In addition to suspending the tubing strings that extend into the wellbore, the tubing hanger also provides interfaces for signal pathways (e.g., hydraulic supply lines, chemical supply lines, electrical monitoring lines, medium to high voltage electrical lines, fiber optic lines, and/or wireless communication components) to control various completion equipment in the wellbore below. Thus, a subsea device (e.g., a vertical tree) mounted atop the tubing hanger must be capable of extending these signal pathways from devices from above through the tubing hanger.

Figure 2A:
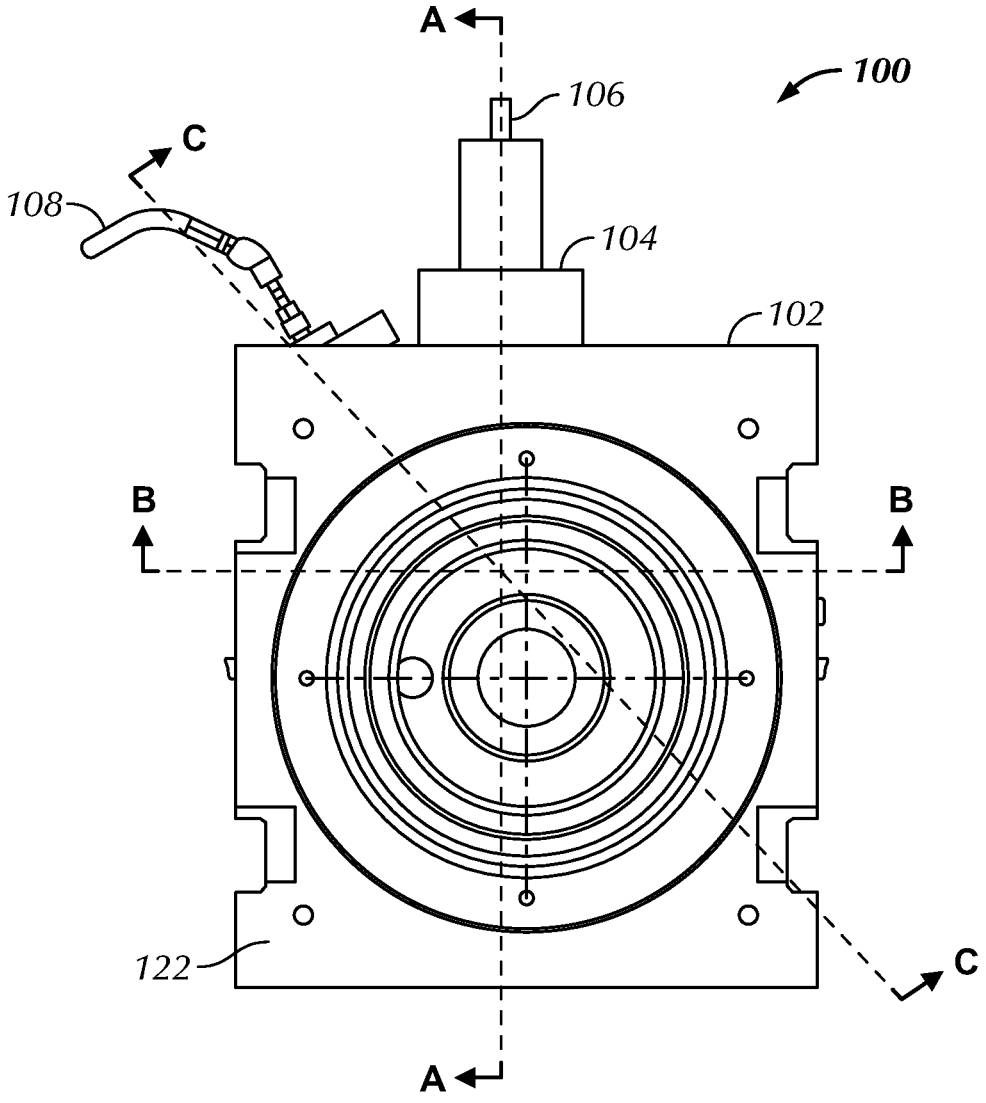
FIG. 2A is view of a vertical tree assembly in accordance with embodiment disclosed herein.
Figure 2B:
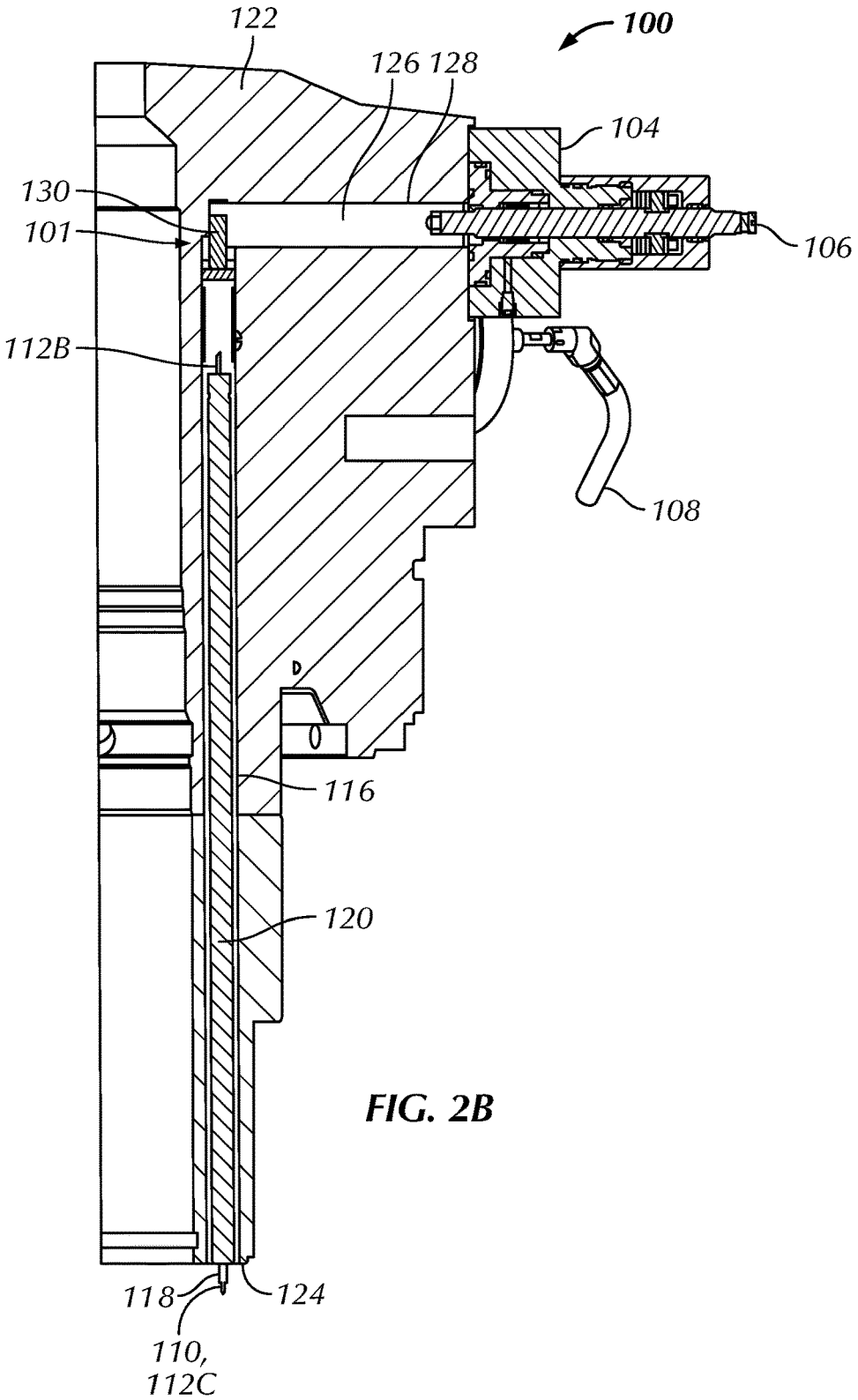
FIG. 2B is a sectioned side-view drawing of the vertical tree assembly of FIG. 2A from the perspective of section line A-A.
Figure 2C:
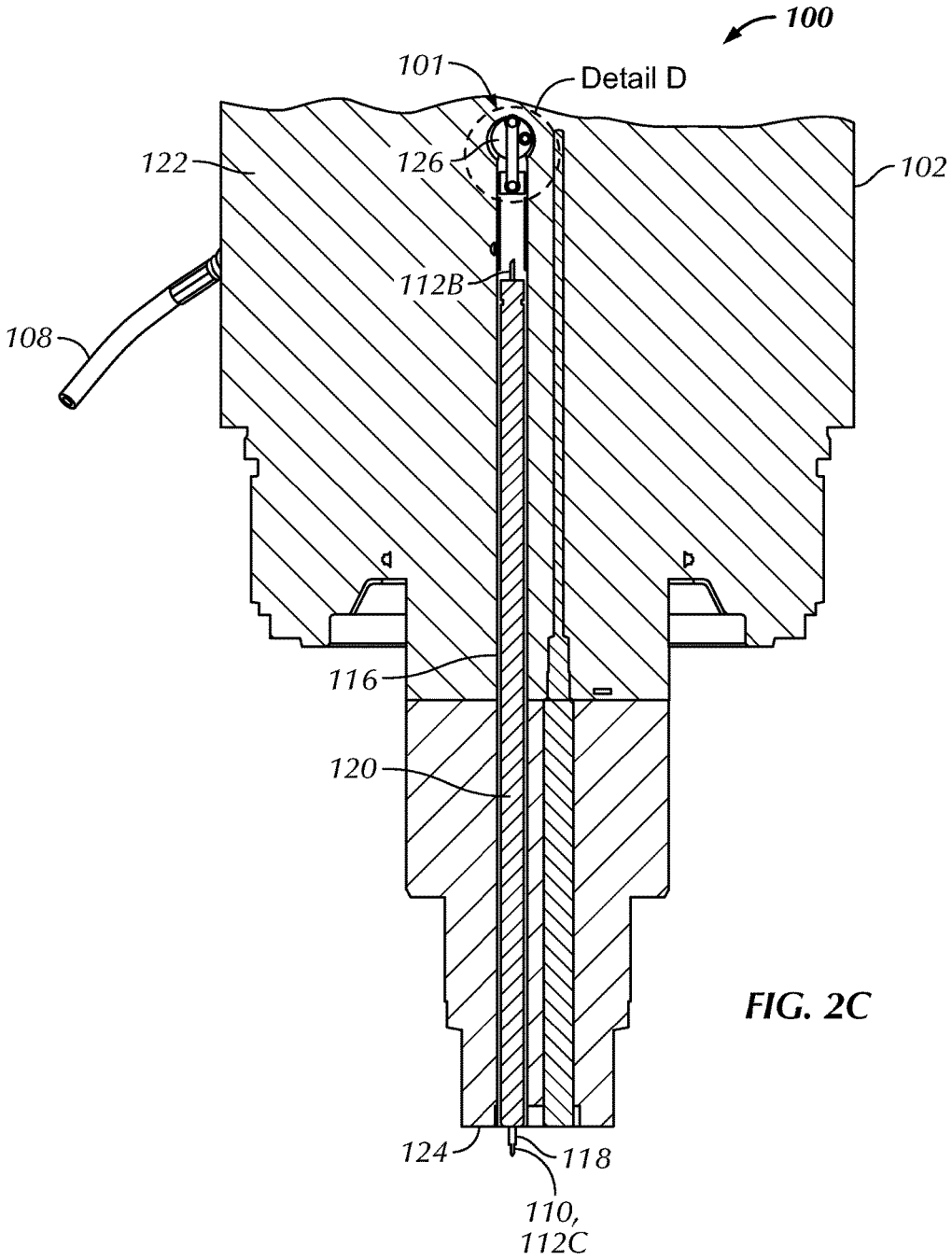
FIG. 2C is a sectioned side-view drawing of the vertical tree assembly of FIG. 2A from the perspective of section line B-B.
Figure 2D:
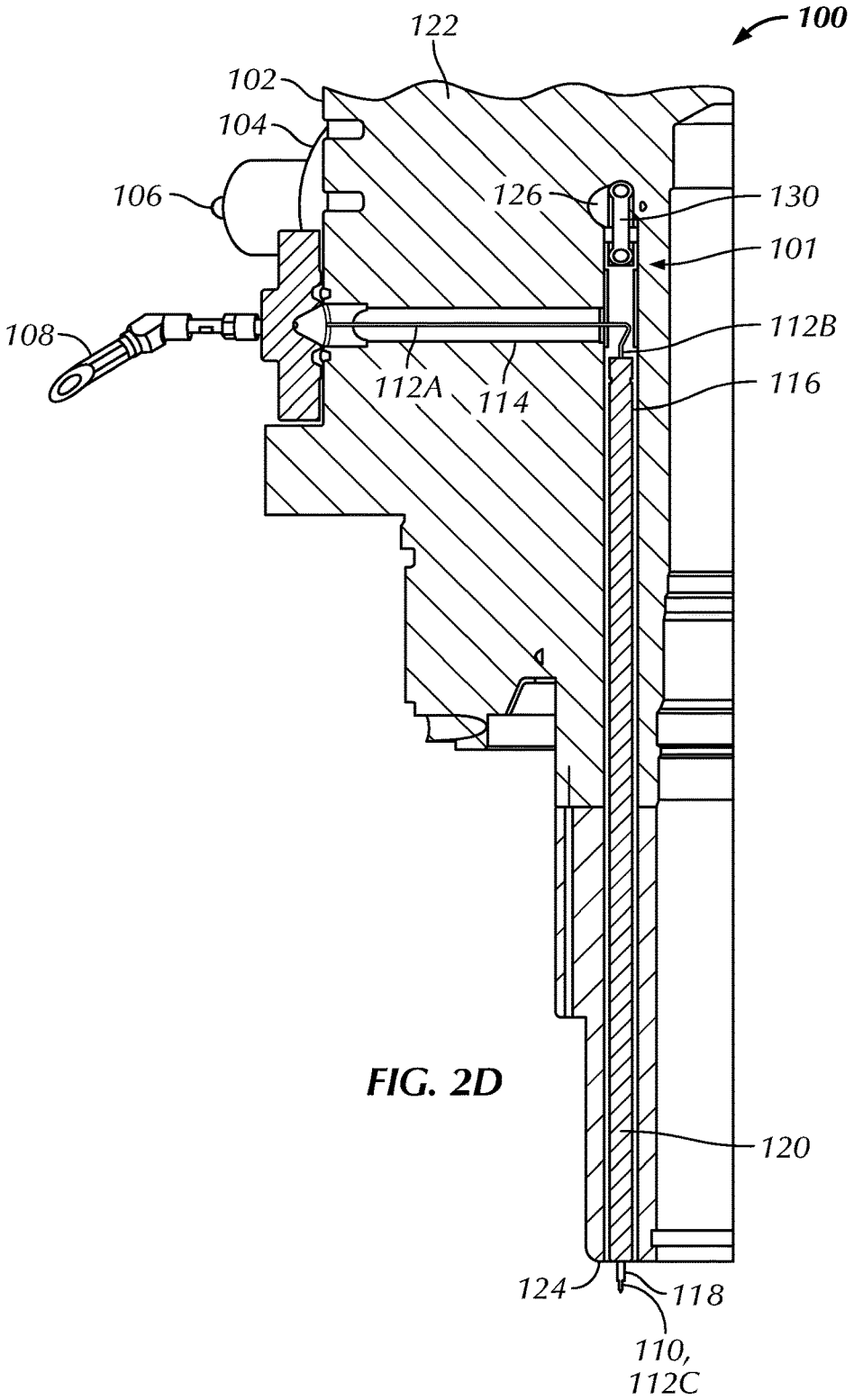
FIG. 2D is a sectioned side-view drawing of the vertical tree assembly of FIG. 2A from the perspective of section line C-C.
Figure 2E:
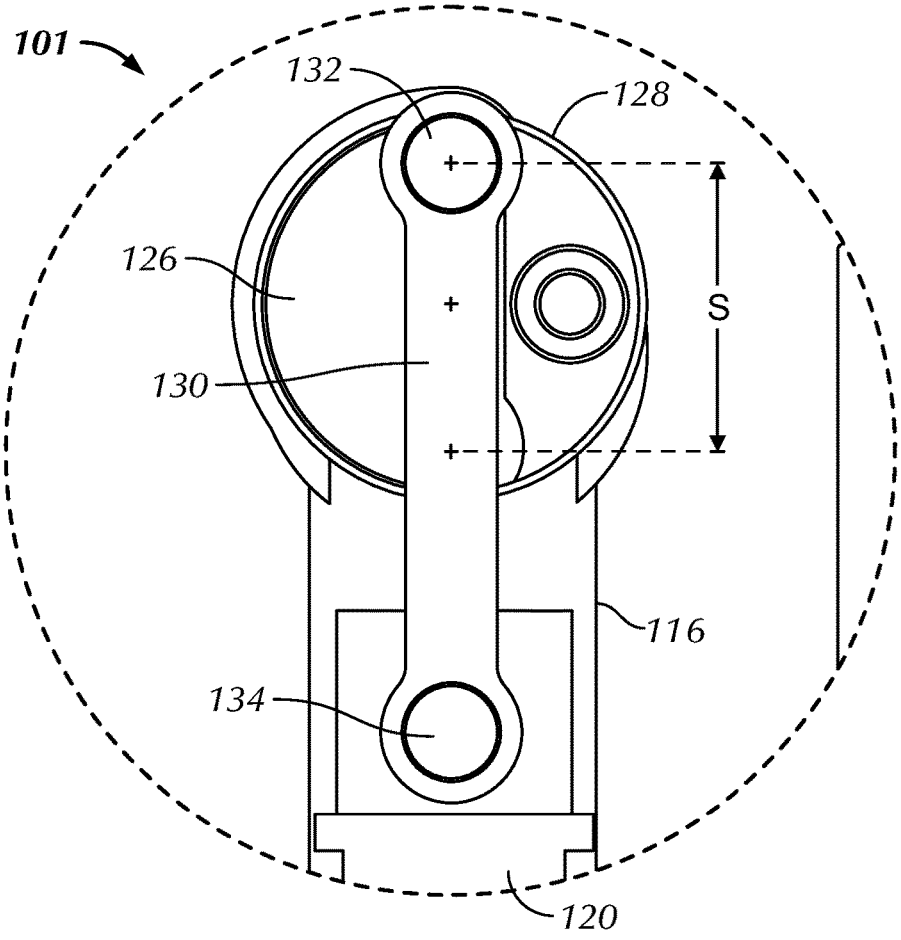
FIG. 2E is a magnified view of a slider crank mechanism of the vertical tree assembly of FIG. 2A-D identified as Detail D in FIG. 2C.

Referring now to FIGS. 2A-E, multiple views of an exemplary embodiment of a vertical tree assembly 100 having signal pathway components in accordance with the present disclosure is shown. FIG. 2A depicts a top view drawing of a vertical tree 100, FIG. 2B depicts vertical tree 100 along section line A-A of FIG. 2A, FIG. 2C depicts vertical tree 100 along section line B-B of FIG. 2A, and FIG. 2D depicts vertical tree 100 along section line C-C of FIG. 2A. FIG. 2E depicts a close-up view of a slider-crank assembly 101 shown in FIG. 2C at Detail D. Vertical tree 100 of FIGS. 2A-E includes a main body 102, an ROV control boss 104 including a manipulation interface 106, a signal pathway input 108, and a signal pathway output 110. As shown in FIG. 2D, a signal pathway 112A, 112B, 112C, extends from input 108, through a horizontal cavity 114, through a vertical cavity 116, and out through pathway output 110. While signal pathway (108, 112A, 112B, 112C, and 110) of FIGS. 2A-E is depicted as an electrical conduit, those having ordinary skill in the art will appreciate that alternative signal pathways (e.g., hydraulic, mechanical, pneumatic, and fiber-optic) may be used with vertical tree 100 without departing from the present disclosure.

A first component 118 of a signal pathway to extend between vertical tree assembly 100 and a proximal subsea wellhead device (not shown) is shown protruding from the body 102 of vertical tree 100. First component 118 is depicted schematically as a wetmateable electrical connector, however any mechanism for connecting (wetmateable or otherwise) a signal pathway between adjacent subsea wellbore devices may be used. As shown in FIGS. 2A-D, first signal pathway component 118 is configured to be reciprocated or "stroked" up or down relative to body 102 (and subsea wellhead device below) upon a piston 120 extending between proximal 122 and distal 124 ends of vertical tree 100. A corresponding second component (not shown) of the signal pathway extending between vertical tree 100 and the subsea wellhead device below is configured to receive first component 118 as it is stroked from a fully disengaged (proximal) position to a fully engaged (distal) position. As such, second component may be any structure corresponding to and configured to receive first component 118 as it is stroked from disengagement to engagement by piston 120. While the embodiment disclosed in FIGS. 2A-2E is described as the first component 118 of the signal pathway reciprocating into and out of engagement with the second component below, it should be understood that alternatively, the second component may reciprocate into and out of engagement with the first component 118 above. Alternatively still, both the first 118 and second component of the signal pathway may reciprocate into and out of engagement with each other.

Referring still to FIGS. 2A-E, one embodiment of a reciprocation mechanism (i.e., slider-crank assembly 101) may be described. Referring now to FIGS. 2B and 2E, slider crank assembly 101 is shown extending from control boss 104 mounted to outside of vertical tree 100 body 102. A crank bar 126 extends from manipulation interface 106 to vertical cavity 116 through a horizontal crank cavity 128. At the termination of horizontal crank cavity 128 with vertical cavity 116, a thrust link 130 connects a pin journal 132 of crank bar 126 to a pin journal 134 of piston 120, such that rotation of crank bar 126, rotates link 130 from top most position (shown) to a bottom position (e.g., step C of FIG. 3) in approximately one half turn of crank bar 126. Thus, as manipulation interface 106 is rotated (e.g., by a subsea ROV or a human operator) one-half turn, crank bar 126 and thrust link 130 operate to displace piston 120 and first component of signal pathway 118 downward one full stroke S. When retraction of first component 118 is desired, crank bar 126 may be rotated one-half turn in the opposite direction.

Referring briefly again to FIG. 2D, signal pathways 112A and 112B are shown constructed such that displacement of piston 120 through stroke S does not disrupt the continuity of signal passing from input 108 to output 110. As shown, horizontal cavity 114 and signal pathway 112A are selected such that the vertical displacement of piston 120 and signal pathway 112B a distance of S will not harm the integrity of the signal extending therethrough. In particular, horizontal cavity 114 may be constructed of a gauge substantially similar to the total amount of stroke S such that signal pathway 112A may reciprocate within horizontal cavity 114 the same vertical distance S as piston 120.

Figure 3:
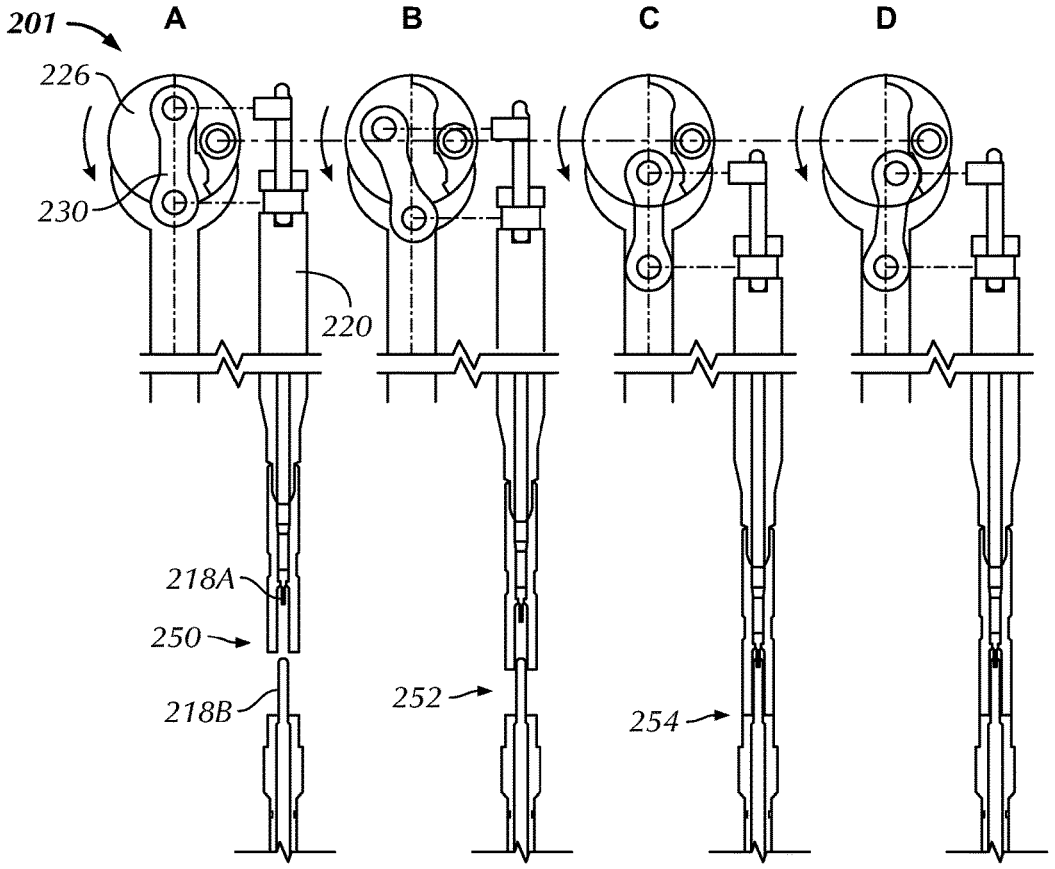
FIG. 3 is a side view drawing of a slider crank mechanism depicted in stages A-D in accordance with embodiments disclosed herein.

Referring now to FIG. 3, a slider-crank mechanism 201 in accordance with embodiments disclosed herein is shown schematically with corresponding piston 220 positions in three successive steps A-D. In step A, crank bar 226, link 230, and piston 220 are shown in their uppermost or disengaged position. Step B depicts crank bar 226, link 230, and piston 220 in an intermediate position, and Step C depicts crank bar 226, link 230, and piston 220 in their lowermost or fully engaged position. Step D, depicts crank bar 226 in an over-rotated position and locked position, such that any upward vertical thrusting of piston 220 will result in link 230 and crank bar 226 binding so as to prevent undesired displacement of piston 220. Additionally, as shown in each step A-D, a connection between a first component 218A and a second component 218B of a signal pathway is shown in various states of engagement. Referring to Step A, first component 218A is fully disengaged 250 and not in communication with second component 218B. Step B depicts partial engagement 252 between components 218A and 218B, while steps C and D depict fully engagement 254 between first 218A and second 218B components of signal pathway. Furthermore, it should be understood that corresponding components 218A, 218B of the signal pathway shown schematically in FIG. 3 depicts the first (or upper) component 218A of the signal pathway as a socket to correspond with the connector or plug design of the second component 218B of the signal pathway. Those having ordinary skill will appreciate that the specific designs and configurations of components (218A, 218B) of the signal pathway may be reversed or chosen from an entirely different configuration altogether.

Additionally, while the mechanism for engaging and disengaging the components (118, 218A, 218B) of the signal pathway disclosed herein is a slider-crank-style mechanical mechanism, a person having ordinary skill will appreciate that alternative mechanisms may be used without departing from the scope of the claimed subject matter. In particular, slider-crank mechanism 101, 201 may be replaced with a hydraulic, pneumatic, electrical, or electro-mechanical mechanism to stroke piston 120, 220 up and down to facilitate disengagement and engagement of first component 118, 218A with second component 218B of signal pathway.

Advantageously, embodiments disclosed and claimed herein may allow more reliable communications through signal pathways extending between adjacent devices of oilfield stack assemblies. In particular, performance of certain electrical, hydraulic, and/or fiber optic signal pathways may be linked to the cleanliness between the two components of the signal pathway making the connection across devices. Often, signal path connections systems having such cleanliness sensitivity, whether they be wetmateable or not, have a mechanism built within their design to wipe, clean, or otherwise re-energize the ends as the connection is made. However, with such designs, the connection may require multiple engagement/disengagement strokes in order to effectively clean any debris or other material (e.g., trapped sea-water) that might otherwise restrict or prohibit effective signal communication thereacross. Not only can a stroking mechanism between adjacent subsea wellhead devices satisfy the multiple engagements needed to clean, verify, and energize the signal pathway, it may also provide the ability to control the speed at which the signal pathway connection is made. Because the velocity of landing one subsea wellhead device to another can vary significantly depending on a number of factors, the signal path components might otherwise become damaged from physical impact or exposure to conditions which would otherwise be detrimental to the performance of the signal pathway.

Advantageously still, another benefit to the embodiments disclosed herein is the ability (in hydraulic or pneumatic systems) to monitor for pressure leakage past the signal pathway connection with the wetmateable components disassembled. For example, in a hydraulic signal pathway having disengaged wetmateable components, the ability of the devices below the disengaged connection to retain pressure may be measured without the need to separate the upper subsea wellhead device from the lower subsea wellhead device. At large depths of sea water, the ability to monitor pressure integrity below a connection between wellhead devices without physically separating them, an operation that would consume significant amounts of time and/or expense, would be highly desire able.

As an example, a downhole chemical injection line typically includes a hydraulic coupler with a poppet check valve. When a subsea wellhead component (e.g., a tree) is landed on top of another subsea wellhead component (e.g., a tubing hanger), a pressure containing/controlling signal pathway for the chemical fluid is established. Because the chemical line typically includes check valves near the reservoir, these check valves and the poppet check valve can be barriers between the production fluid and the environment when the tree is not present. Using systems available today, the pressure integrity of the check valves cannot be verified prior to removing the tree assembly. Having the ability to disengage the chemical wetmateable signal path and monitor for pressure leakage into the cavity above a tubing hanger prior to removing the tree reduces the risk of potential environmental exposure and would mark a significant advantage to subsea oilfield drilling and production options.

While the disclosure has been presented with respect to a limited number of embodiments, those skilled in the art, having benefit of this disclosure, will appreciate that other embodiments may be devised which do not depart from the scope of the present disclosure. Accordingly, the scope of the invention should be limited only by the attached claims.

What is claimed is:

1. A method to communicate between a first subsea device and a second subsea device, the method comprising:

disposing a first component of a signal pathway upon a distal end of the first subsea device;

disposing a second component of the signal pathway upon a proximal end of the second subsea device;

engaging the first subsea device with the second subsea device; and engaging the first component of the signal pathway with the second component of the signal pathway, wherein the engaging comprises rotating a manipulation interface mounted on and extending radially from an outer surface of the first subsea device to operate a crank bar and thrust link to displace a piston and stroke the first component of the signal pathway.

2. The method of claim 1, further comprising engaging the first and second components of the signal pathway after engaging the first and the second subsea devices.

3. The method of claim 1, further comprising testing the integrity of the signal pathway following engagement of the first component and second components.

4. The method of claim 3, further comprising:

disengaging the first and second components of the signal pathway while maintaining the engagement of the first and second subsea devices;

re-engaging the first and second components of the signal pathway; and re-testing the integrity of the signal pathway following re-engagement of the first and second components.

5. The method of claim 1, wherein the engaging of the first component with the second component comprises displacing at least one of the first component and the second component toward the other of the first component and the second component after the first subsea device is engaged with the second subsea device.

6. The method of claim 1, wherein one of the first and second components of the signal pathway comprises a male connection.

7. The method of claim 6, wherein the other of the first and the second components of the signal pathway comprises a female connection corresponding to the male connection.

8. The method of claim 1, wherein at least one of the first and second components of the signal pathway is wetmateable.

9. The method of claim 1, wherein the first subsea device comprises a vertical tree assembly.

10. The method of claim 1, wherein the second subsea device comprises at least one of a tubing hanger, a wellhead, and a tubing head.

11. The method of claim 1, further comprising permitting communication between the first and second subsea devices through the engaged first and second components of the signal pathway.

12. A communication link between a first subsea device and a second subsea device, the communication link comprising:

a first component positioned upon a distal end of the first subsea device;

a second component positioned upon a proximal end of the second subsea device;

wherein one of the first and second components comprises an engaged position and a disengaged position;

wherein the one of the first and second components is configured to be displaced from the disengaged position to the engaged position by a slider-crank mechanism after the first and second subsea devices are engaged, and wherein the one of the first and second components is configured to be displaced from the engaged position to the disengaged position by the slider-crank mechanism.

13. The communication link of claim 12, wherein:

the other of the first and second components comprises an engaged position and a disengaged position; and the other of the first and second components is configured to be displaced from the disengaged position to the engaged position after the first and second subsea devices are engaged.

14. The communication link of claim 13, wherein both of the first and second components are configured to be displaced from the disengaged position to the engaged position simultaneously.

15. The communications link of claim 12, wherein the one of the first and second components is configured to be displaced from the engaged position to the disengaged position while the first and second subsea devices remain engaged.

16. The communications link of claim 12, further comprising an electrical signal pathway extending across the first and second components when the one of the first and second components is in the engaged position.

17. The communications link of claim 12, further comprising a fiber-optic signal pathway extending across the first and second components when the one of the first and second components is in the engaged position.

18. The communications link of claim 12, further comprising a hydraulic signal pathway extending across the first and second components when the one of the first and second components is in the engaged position.

19. A method to extend a signal pathway across an adjacent pair or oilfield devices, the method comprising:

landing a first oilfield device comprising a first component of the signal pathway to a second oilfield device comprising a second component of the signal pathway; coupling first oilfield device to the second oilfield device;

selectively engaging the first component of the signal pathway with the second component of the signal pathway by a slider-crank mechanism, the slider-crank mechanism comprising an input mechanism mounted on a radial outer surface of the first oilfield device; and testing the integrity of the signal pathway extending across the first oilfield device and the second oilfield device.

20. The method of claim 19, further comprising:

maintaining the first oilfield device and the second oilfield device in a coupled configuration;

disengaging the first component of the signal pathway from the second component of the signal pathway; and re-testing the integrity of the signal pathway extending across the first oilfield device and the second oilfield device.

21. The method of claim 19, further comprising transmitting at least one of electrical, hydraulic, pneumatic, fiber-optic, and mechanical signals across the signal pathway.

* * * * *